US007350863B2

(12) United States Patent
Engels et al.

(10) Patent No.: US 7,350,863 B2
(45) Date of Patent: Apr. 1, 2008

(54) HEIGHT-ADJUSTABLE WORK CHAIR

(75) Inventors: Paul Arthur Engels, 14 Bosbeeklaan, Santpoort-Noord (NL) 2071 AL; Joannes Henricus Maria de Kroon, Doornspijk-t Harde (NL); Gaston Lionel van Amerongen, Maarssen (NL)

(73) Assignee: Paul Arthur Engels, Santpoort-Noord (NL)

( * ) Notice: Subject to any disclaimer, the term of this patent is extended or adjusted under 35 U.S.C. 154(b) by 48 days.

(21) Appl. No.: 10/573,946

(22) PCT Filed: Sep. 2, 2004

(86) PCT No.: PCT/NL2004/000610

§ 371 (c)(1),
(2), (4) Date: Mar. 29, 2006

(87) PCT Pub. No.: WO2005/030007

PCT Pub. Date: Apr. 7, 2005

(65) Prior Publication Data

US 2006/0267389 A1 Nov. 30, 2006

(30) Foreign Application Priority Data

Sep. 30, 2003 (NL) ..... 1024413

(51) Int. Cl.

| | |
|---|---|
| ***A47C 3/026*** | (2006.01) |
| ***A47C 3/20*** | (2006.01) |
| ***A47C 3/40*** | (2006.01) |
| ***A47C 7/14*** | (2006.01) |
| ***A47C 1/032*** | (2006.01) |

(52) U.S. Cl. ..... 297/284.11; 297/284.1; 297/284.9; 297/300.1; 297/302.1; 297/302.2; 297/312; 297/344.18; 297/344.19; 297/284.3

(58) Field of Classification Search ..... 297/284.11, 297/284.1, 284.3, 284.9, 312, 344.18, 344.19, 297/452.4, 300.1, 302.1, 302.2
See application file for complete search history.

(56) References Cited

U.S. PATENT DOCUMENTS 2,578,879 A 12/1951 De Young (Continued)

FOREIGN PATENT DOCUMENTS

WO WO90/12220 10/1990

(Continued)

*Primary Examiner*—Rodney B. White
(74) *Attorney, Agent, or Firm*—Hoffmann & Baron, LLP

(57) ABSTRACT

Work chair, comprising a seat, supported in a height-adjustable manner by a column on a foot, and an adjustable backrest, the seat, at least in part, having a substantially horizontal position, and the backrest promoting an upright position of the user's back, characterized in that the column (3) is composed of three parts (4, 5, 6) and as a result provides a two-stage adjustability for the seat height, in that the seat is divided into two parts (7, 8), in such a manner that a rear section (7) is fixed and always retains the substantially horizontal position, while a front section (8) is hinged with respect to the rear section, and in that the front section (8) is secured to the column (3) in a hinged manner (11) by a rod (9) secured to it in a hinged manner (10). The chair can be dimensioned in such a way that it allows an ergonomic working position to be adopted by virtually all users, irrespective of their corporal size, with the possibility of increasing the size of the workstation.

5 Claims, 1 Drawing Sheet

U.S. PATENT DOCUMENTS

| | | | | | |
|---|---|---|---|---|---|
| 3,446,532 | A | | 5/1969 | Cramer | 297/312 |
| 4,380,352 | A | * | 4/1983 | Diffrient | 297/302.1 X |
| 4,616,337 | A | * | 10/1986 | Sheth | 297/284.9 X |
| 5,009,466 | A | * | 4/1991 | Perry | 297/300.1 X |
| 5,401,077 | A | | 3/1995 | Hosoe | 297/344.19 X |
| 5,435,623 | A | | 7/1995 | Kapec et al. | 297/284.11 X |
| 5,447,358 | A | | 9/1995 | Corlett | 297/344.18 |
| 5,536,067 | A | * | 7/1996 | Pinto | 297/284.11 |
| 5,716,099 | A | * | 2/1998 | McDiarmid | 297/302.1 |
| 6,752,459 | B2 | * | 6/2004 | Deisig | 297/344.19 X |
| 6,890,030 | B2 | * | 5/2005 | Wilkerson et al. | 297/284.11 |

FOREIGN PATENT DOCUMENTS

| | | |
|---|---|---|
| WO | WO93/17604 | 9/1993 |
| WO | WO97/46144 | 12/1997 |
| WO | WO01/60211 | 8/2001 |

* cited by examiner

HEIGHT-ADJUSTABLE WORK CHAIR

CROSS-REFERENCE TO RELATED APPLICATIONS

This application is the National Stage of International Application No. PCT/NL2004/000610, filed Sep. 2, 2003, which claims the benefit of Netherlands Application No. NL 1024413, filed Sep. 30, 2003, the contents of which is incorporated by reference herein.

FIELD OF THE INVENTION

The invention relates to a work chair, comprising a seat, supported in a height-adjustable manner by a column on a foot, and an adjustable backrest, the seat, at least in part, having a substantially horizontal position, and the backrest promoting an upright position of the user's back.

BACKGROUND OF THE INVENTION

The aim of all height-adjustable chairs is to make a working area easy to reach. A working area of this type may, for example, be a table or desk, a moving belt or a production station, a patient's chair or an operating table.

Numerous designs of work chairs of this type are known. Individual differences in body length have led to height-adjustable work chairs with various forms of seats which are likewise semi-adjustable and/or tiltable. Hitherto, however, no work chair has been disclosed which actually takes full account of the individual size of a person. Most chairs are either too small for tall users or too large for small users.

In addition, sitting in a raised position on a traditional seat—depending on the dimensions of this seat—leads to undesirable pressure effects on both the vascular system and the muscular system.

Nature designed the human leg and pelvis complex for people to be standing and walking in an upright position. Therefore, it is explained in anatomical manuals that the muscle masses are located on the opposite side from the direction of movement. Therefore, the lower leg being at the front, the muscle mass is on the rear side, the upper leg being to the rear, the muscle mass is at the front, and the pelvis being at the front, the muscle mass is at the rear side. The upper and lower legs pivot with respect to one another at the knee, the upper legs and pelvis do the same at the hip joints. These anatomical facts mean that at the back of the knee there is a sharply delimited transition from the upper leg to the lower leg, whereas the transition from the pelvis to the upper leg has a relatively rounded boundary in the form of the horizontal buttock pleat. This pleat is partially dependent on the mass of the buttock and thigh muscles. In anatomical terms, the sitting posture is characterized by support on the ischium nodes of the two halves of the pelvis. In mechanical terms, for a balanced sitting posture, it is most expedient for the thigh bone position to be horizontal and the position of the lower leg to be vertical.

The anatomical-mechanical data are independent on the notion comfort. The latter is partly determined by the extent of support for the upper legs, the extent to which the seat is tilted backwards and the degree of support for the back.

However, this information is not relevant or is differently relevant when designing a work chair. Here, the starting point needs to be the possibility of adopting an active working posture, upright and symmetrical, i.e. for the head/neck posture, shoulder position and the forwards movement of the upper arm and upwards movement of the lower arm/hand with respect to the horizontal position not leading to injury to or overloading of the kinetic chain of the human body.

SUMMARY OF THE INVENTION

In view of these considerations, it is an object of the invention to optimize and maximize the working height of the sitting position with respect to the working area, as is anatomically permitted by the individual lengths of the lower and upper legs. In particular, it is an object of the invention for this to let this apply to users of virtually all corporeal sizes encountered, not only for the different heights of the body, but also for the different lengths of the parts of the body: lower leg, upper leg and back. Furthermore, the invention seeks to make the height adjustability variable for the position of the upper leg from 90° to 130° with respect to the trunk in the vertical position.

Therefore, the invention arrives at the following conditions which the adjustability of a work chair to be developed needs to satisfy:

1) The chair must make it possible to work in an active sitting position with respect to the working area.
2) The chair must be adjustable in relation to the individual body heights and height ratios.
3) The chair must offer maximum support at a selected or intended working area position.
4) The chair must provide the option of stabilizing the maximum support.

The chair according to the invention, in its basic concept, is characterized in that the column provides a two-stage adjustability of the seat height, in that the seat is divided, in such a manner that a rear section is fixed and always retains the substantially horizontal position while a front section is hinged with respect to the rear section, and in that the front section is secured to the column in a hinged manner by a rod secured to it in a hinged manner.

The first height adjustment determines the individual setting of the seat height on the basis of the lower-leg length.

The second height adjustment makes the chair, within the objectives set by the invention, suitable for use for small users, but also provides the option of increasing the size of the workstation. The use of a divided seat in the design makes it possible to achieve a responsible maximum height adjustment while, on account of the fact that the front section of the seat can be lowered continuously, during the second height adjustment, no violent force is applied to the anatomical structures of the upper leg.

The chair can be dimensioned in such a way that it is in all respects suitable for users covered by P1 and P99 of the Dined 2003, the Dutch tables for height and width dimensions of the Dutch population. Since the Dutch are one of the two tallest peoples of the world, the adjustability is considered to be suitable for use throughout the world.

U.S. Pat. Nos. 3,445,532 and 5,401,077 have disclosed chairs whose seat has a fixed section and a front section which is hinged with respect to the fixed section. The other characteristics of the invention are not known from these documents.

BRIEF DESCRIPTION OF THE DRAWINGS

The invention will be explained below with reference to the appended drawing showing a diagrammatic illustrated exemplary embodiment. In the drawing.

DETAILED DESCRIPTION OF PREFERRED EMBODIMENTS

Figure 1:
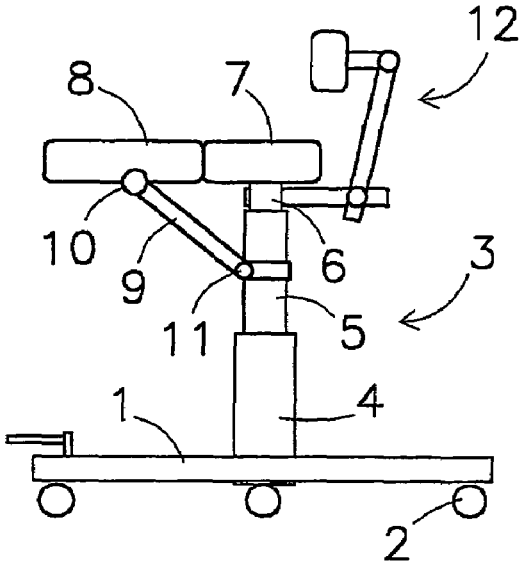
FIG. 1 shows a side view of the chair in an intermediate position.

A three-part column 3 is positioned on a foot 1, which can be moved in a known way on a set of wheels, such as 2, on a centre axis of at least 50 cm. The telescopic parts of the column are respectively indicated by 4, 5 and 6.

The top column 6 bears a fixed part 7 of the seat, intended to support the ischial bones. The seat is dividable: a front seat part 8, intended to support the upper legs, is hinged with respect to the fixed, rear part 7.

Seat part 8 is stabilized by means of a rod 9. This rod begins at a hinge 10 arranged on the underside of seat part 8 and continues towards a hinged securing position 11 on the central middle column 5. As long as only the central middle column 5 is raised—as shown in FIG. 1—the seat 7, 8 remains flat. In the event of any raising of the third column 6, rod 9 pulls the front seat part 8 with it into an inclined position, as shown in its extreme position in FIG. 2.

A backrest, denoted overall by 12, is arranged on the top column 6. A sliding coupling 13 between a fixed rod 14 secured to column 6 and an upwardly running rod 15 enables the height of those parts of the rest 12 which come into contact with the pelvis of the user to be adjusted and—through tilting of the rod 15—also to be moved forwards and backwards with respect to the rear edge of the fixed seat part 7.

Furthermore, rod 17 allows the backrest parts 16 to be adjusted forwards/backwards. A coupling 18 between rod 15 and rod 17 ensures, by means of a mechanism which is known per se, that the horizontal position of rod 17 is retained when the vertical rod 15 is tilted.

Figure 3:
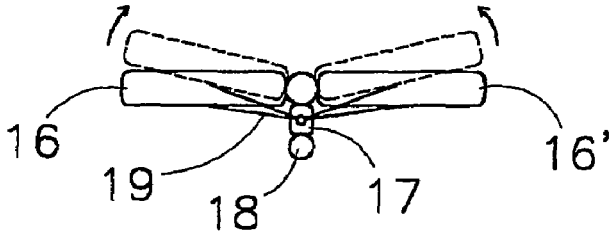
FIG. 3 shows a plan view of the backrest.

The backrest is characterized by a division into two halves 16, 16' (cf. FIG. 3) lying in front of the coupling 17. This division into two parts prevents the backrest from coming into contact with the spinal column. The two supporting rest halves 16, 16' are pressed pivotably forwards a certain distance by a passive spring system 19, as indicated by dashed lines and arrows P. They can then be pressed back, at most into a straight line with respect to one another, under a gentle pressure, the straight-line position being indicated by solid lines. The overall assembly leads to passive supporting contact of the backrest parts 16, 16' with the two halves of the user's pelvis.

The pelvis support designed in this way enables people to sit in such a manner, set individually on the basis of anatomical and neuro-physiological data, that the horizontal buttock pleat is positioned precisely at the transition from seat part 7 to seat part 8. The shape can be influenced by a slight lengthening of a backrest half as a rounded section on the distal side.

The dimensioning can be selected as follows. In a horizontal position of the seat parts 7 and 8, the height of the columns 4 and 5 can be adjusted from 35 to 55 cm. Seat part 7 is made to be 15 cm long (in the forward/backward direction), and seat part 8 is made to be 20 cm long. The height of the backrest 12 (parts 16 and 16') to the edge of the pelvis is made variable from 15 to 25 cm. In the forward/backward direction, the backrest can be varied by 12 cm with respect to the rear edge of seat part 7. This can be divided into +6 and −6 cm with respect to the said rear edge of the seat part 7.

Figure 2:
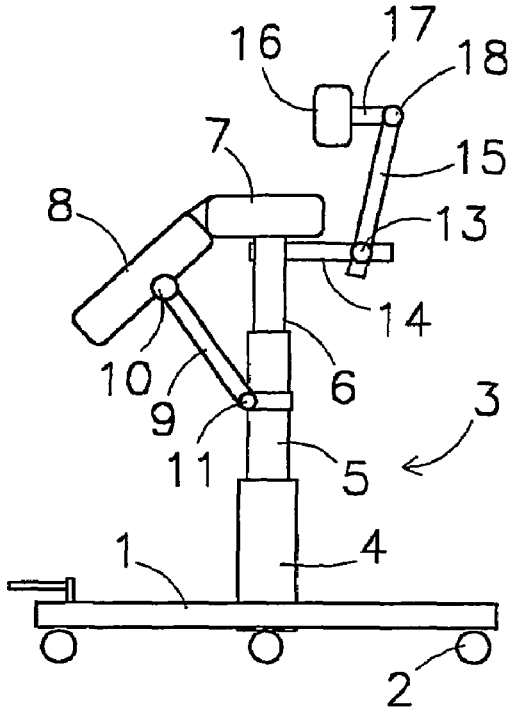
FIG. 2 shows a side view of the chair in its highest position.

The third stage of the column, column 6, results in a maximum additional elevation of approximately 20 cm. Any degree of elevation causes rod 9 to pull the front section 8 of the FIG. 1 and the maximum of 130° as shown in FIG. 2, with the effective seat section 7 in terms of the ischial nodes and the support as far as the horizontal buttock pleat being retained.

To summarize, therefore, the invention provides the following new measures:

a) the dividable seat, b) the individual height adjustability, in an ergonomically responsible way, to a maximum value for virtually all corporeal sizes of users, c) the adjustable position of the backrest with respect to the upper edge of the iliac crest, d) the adjustable position of the lateral backrest parts based on the real musculoskeletal pelvis width, e) the absence of support at the location of the spinal column, to prevent the occurrence of compensatory movement adjustments.

With this working chair, it is possible to adopt an ergonomically appropriate sitting position under various working conditions, starting from an active sitting position with a horizontal positioning of the upper legs. The double height adjustment makes it possible to work up to 20 cm above the individual horizontal seat plane with adequate support for the upper legs.

What is claimed is:

1. A work chair having two-stage height adjustability for accommodating lengths of upper and lower legs of a user comprising:

a foot;

a telescoping column comprising a top column part, a central middle column part and a bottom column part, the bottom column part being positioned on the foot;

a seat supported in a height-adjustable manner by the telescoping column, the seat comprising a front part and a rear part, where the front part of the seat is hinged to the rear part of the seat, the rear part of the seat being secured in a substantially horizontal position to the top column part, the front part of the seat being secured to the central middle column part in a hinged manner by a rod having two hinges, one hinge being secured to an underside portion of the front part of the seat and the other hinge being secured to a securing position on the central middle column part; and an adjustable backrest for promoting an upright position of a user's back, the adjustable backrest being moveably arranged to the top column part by a coupling, the coupling comprising a first fixed rod secured to the top column part, a second fixed rod secured to the adjustable backrest, and an upwardly running rod tiltably and slidably coupled to the first fixed rod and tiltably coupled to the second fixed rod so that the second rod is horizontally disposed, whereby a height of the rear part of the seat is adjustable via the telescoping column to accommodate a length of a lower leg of a user and the front part of the seat hingingly pivots to accommodate a length of an upper leg of a user as the height of the rear part of the seat is adjusted.

2. The work chair according to claim 1, wherein the top column part is dimensioned in such a way that a height of the seat, as determined by the rear part of the seat, has an individual setting based on lower-leg lengths of users encountered.

3. The work chair according to claim 1, wherein the top column part is dimensioned in such a way that a height of the seat, as determined by the rear part of the seat, has an individual based on a lower-leg length of an user encountered, and wherein the central middle column part has a maximum height adjustment which gives a maximum inclined position of 130°, relative to the telescoping column, for the front part of the seat to accommodate curvature of a thigh with respect to an upright trunk of an user encountered, where the front part of the seat has a inclined position of 90°, relative to the telescoping column, when the front part of the seat is horizontal to the rear part of the seat.

4. The work chair according to claim 1, wherein the adjustable backrest comprises two parts pivotably connected, whereby the two parts of the adjustable backrest may be pressed forward toward the rear part of the seat so the adjustable backrest does not support a spinal column of a user.

5. The work chair according to claim 1, wherein the adjustable backrest comprises:

two parts and a passive spring system which pivotably presses the two parts of the adjustable backrest forward toward the rear part of the seat.

* * * * *